US009676575B2

(12) United States Patent
Sakai et al.

(10) Patent No.: US 9,676,575 B2
(45) Date of Patent: Jun. 13, 2017

(54) IMAGE FORMING APPARATUS

(71) Applicant: CANON KABUSHIKI KAISHA, Tokyo (JP)

(72) Inventors: Masayuki Sakai, Yokohama (JP); Naoki Kanno, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/627,203

(22) Filed: Feb. 20, 2015

(65) Prior Publication Data

US 2015/0246784 A1 Sep. 3, 2015

(30) Foreign Application Priority Data

Feb. 28, 2014 (JP) ..... 2014-039124
Feb. 10, 2015 (JP) ..... 2015-024266

(51) Int. Cl.
*B65H 7/20* (2006.01)
*B65H 3/06* (2006.01)
*B65H 7/04* (2006.01)

(52) U.S. Cl.
CPC ..... *B65H 7/20* (2013.01); *B65H 3/0607* (2013.01); *B65H 3/0669* (2013.01); *B65H 7/04* (2013.01); *B65H 2403/42* (2013.01); *B65H 2403/512* (2013.01); *B65H 2511/414* (2013.01); *B65H 2511/515* (2013.01); *B65H 2513/10* (2013.01);
(Continued)

(58) Field of Classification Search
CPC ... B65H 1/08; B65H 1/12; B65H 1/14; B65H 1/24; B65H 3/06; B65H 3/0684; B65H 3/0607; B65H 7/00; B65H 7/02; B65H 7/04; B65H 7/20; B65H 2513/10; B65H 2513/102; B65H 2513/104;
(Continued)

(56) References Cited

U.S. PATENT DOCUMENTS 5,815,280 A 9/1998 Ohmura et al.
6,421,581 B1 * 7/2002 Hamamoto ..... B41J 13/0018 271/152
(Continued)

FOREIGN PATENT DOCUMENTS

JP 2002-199794 A 7/2002
JP 2008-301625 A 12/2008
(Continued)

OTHER PUBLICATIONS

Japannese Office Action issued in corresponding Japanese Application No. 2015024266 dated Feb. 14, 2017.

*Primary Examiner* — Prasad Gokhale
(74) *Attorney, Agent, or Firm* — Fitzpatrick, Cella, Harper & Scinto

(57) ABSTRACT

The image forming apparatus includes a plate movable up and down, a control cam that moves the plate up and down, a stepping motor that derives the control cam, a sheet feeding roller that contacts the sheet on the plate moved up by the control cam to feed the sheet held in contact with the feeding unit through rotation caused by drive from the stepping motor, and a control unit that controls the stepping motor. The control unit rotates the stepping motor at a first speed so that the control cam moves the plate up. After the sheet feeding roller is rotated, when the sheet feeding roller is stopped to stop the stepping motor, the control unit changes the rotational speed of the stepping motor from the first speed to a second speed.

35 Claims, 7 Drawing Sheets

(52) U.S. Cl.
CPC ..... *B65H 2513/53* (2013.01); *B65H 2555/26* (2013.01)

(58) Field of Classification Search
CPC ..... B65H 2513/20; B65H 2601/12; B65H 3/0669; B65H 2555/26
USPC ..... 271/152, 154, 155, 162, 126, 127
See application file for complete search history.

(56) References Cited

U.S. PATENT DOCUMENTS 6,900,611 B2 5/2005 Yoshino et al.
7,758,038 B2 * 7/2010 Silverbrook ..... B65H 3/06 271/10.09
8,695,975 B2 * 4/2014 Seki ..... B65H 7/20 271/265.01
8,833,757 B1 * 9/2014 Piening ..... B65H 3/0684 271/121
8,864,132 B2 * 10/2014 Yamagata ..... B65H 7/02 271/256
2005/0218584 A1 * 10/2005 Dan ..... B65H 3/0669 271/127
2008/0251992 A1 * 10/2008 Mo ..... B65H 3/5261 271/127
2009/0057984 A1 * 3/2009 Matsumoto ..... B65H 3/0607 271/10.03
2010/0072691 A1 * 3/2010 Ueda ..... B65H 3/0607 271/110
2012/0217702 A1 * 8/2012 Seki ..... B65H 7/20 271/265.01
2013/0193640 A1 * 8/2013 Kobayashi ..... H04N 1/0473 271/264
2014/0056630 A1 2/2014 Kanno et al.
2014/0232055 A1 * 8/2014 Yamagata ..... B65H 7/02 271/3.18

FOREIGN PATENT DOCUMENTS

JP 2010-189161 A 9/2010
JP 2011-6236 A 1/2011
JP 2011-42463 A 3/2011
JP 2013-151340 A 8/2013

* cited by examiner

IMAGE FORMING APPARATUS

BACKGROUND OF THE INVENTION

Field of the Invention

The present invention relates to an image forming apparatus, and more particularly, to a sheet feeding control.

Description of the Related Art

Hitherto, a stepping motor is often used in an image forming apparatus as a driving unit for a system of feeding and conveying a sheet. Although the stepping motor is small in size and may be manufactured at low cost, a so-called non-synchronous phenomenon frequently occurs, in which rotation of a rotator cannot be synchronized with input of a pulse signal due to overload or rapid change in rotational speed. When the non-synchronous phenomenon occurs under a state in which the rotator is accelerated, the rotator falls out of synchronization with the pulse signal, which stops the sheet feeding and conveying operation. Therefore, in order to prevent occurrence of the non-synchronous phenomenon even in various usage conditions of a user, a stepping motor having a large output torque is sometimes selected for the image forming apparatus. Further, as another countermeasure against the non-synchronous phenomenon, for example, in Japanese Patent Application Laid-Open No. 2008-301625, there is proposed a technology of controlling a drive current of the stepping motor in accordance with the magnitude of the load. Further, for example, in Japanese Patent Application Laid-Open No. 2013-151340, there is proposed a technology of changing the control based on the detected position of the rotor of the stepping motor, to thereby enhance the output efficiency of the stepping motor.

In order to reduce the cost of a sheet feeding mechanism, some image forming apparatus do not include a sensor function for detecting presence or absence of a sheet placed on a plate. In such image forming apparatus, when no sheet is placed on the plate, the plate may directly drive a sheet feeding roller under a state of being urged to the sheet feeding roller. In this case, the maximum load is applied to the stepping motor serving as the driving unit. When the stepping motor falls out of step under this state, the plate is maintained in the state of being urged to the sheet feeding roller, and hence the plate cannot be restored to the normal state. In view of this, the image forming apparatus of this type employs a stepping motor having a high output torque, which does not fall out of step even at a position at which the plate is urged to the sheet feeding roller. However, employment of an expensive stepping motor causes increase in cost.

SUMMARY OF THE INVENTION

The present invention has an object to restore a plate to a normal state from a state of being urged to a sheet feeding roller in an apparatus using a low-output stepping motor.

It is another object of the present invention to provide an image forming apparatus including a plate on which a sheet is to be placed, the plate being movable up and down, a lift unit configured to move the plate up and down, a feeding unit configured to come into contact with the sheet placed on the plate, which is moved up by the lift unit, to thereby feed the sheet held in contact with the feeding unit through rotation, a driving unit configured to drive the lift unit and the feeding unit through rotation, and a control unit configured to execute control of controlling the driving unit so that a rotation number of the rotation of the driving unit is set to a first rotation number, wherein in a case where the feeding unit is pressed by the plate or the sheet placed on the plate, when a non-rotatable condition where the rotation of the feeding unit is inhibited is caused, the control unit executes control of controlling the driving unit so that the rotation number of the rotation of the driving unit is set to a second rotation number smaller than the first rotation number.

It is yet another object of the present invention to provide an image forming apparatus including a plate on which a sheet is to be placed, the plate being movable up and down, a lift unit configured to move the plate up and down, a feeding unit configured to come into contact with the sheet placed on the plate, which is moved up by the lift unit, the sheet held in contact with the feeding unit through rotation, a detection unit configured to detect the sheet fed by the feeding unit, a driving unit configured to drive the lift unit and the feeding unit through rotation; and a control unit configured to execute control of controlling the driving unit so that a rotation number of the rotation of the driving unit is set to a first rotation number, wherein when the detection unit does not detect the sheet even after a first predetermined time has passed from when the control unit controls the driving unit so as to be rotated at the first rotation number, the control unit executes control of controlling the driving unit so that the rotation number of the rotation of the driving unit is set to a second rotation number smaller than the first rotation number.

Further features of the present invention will become apparent from the following description of exemplary embodiments with reference to the attached drawings.

DESCRIPTION OF THE EMBODIMENTS

Now, embodiments of the present invention are described with reference to the drawings.

First Embodiment

[Overall Configuration of Image Forming Apparatus]

Figure 1A:
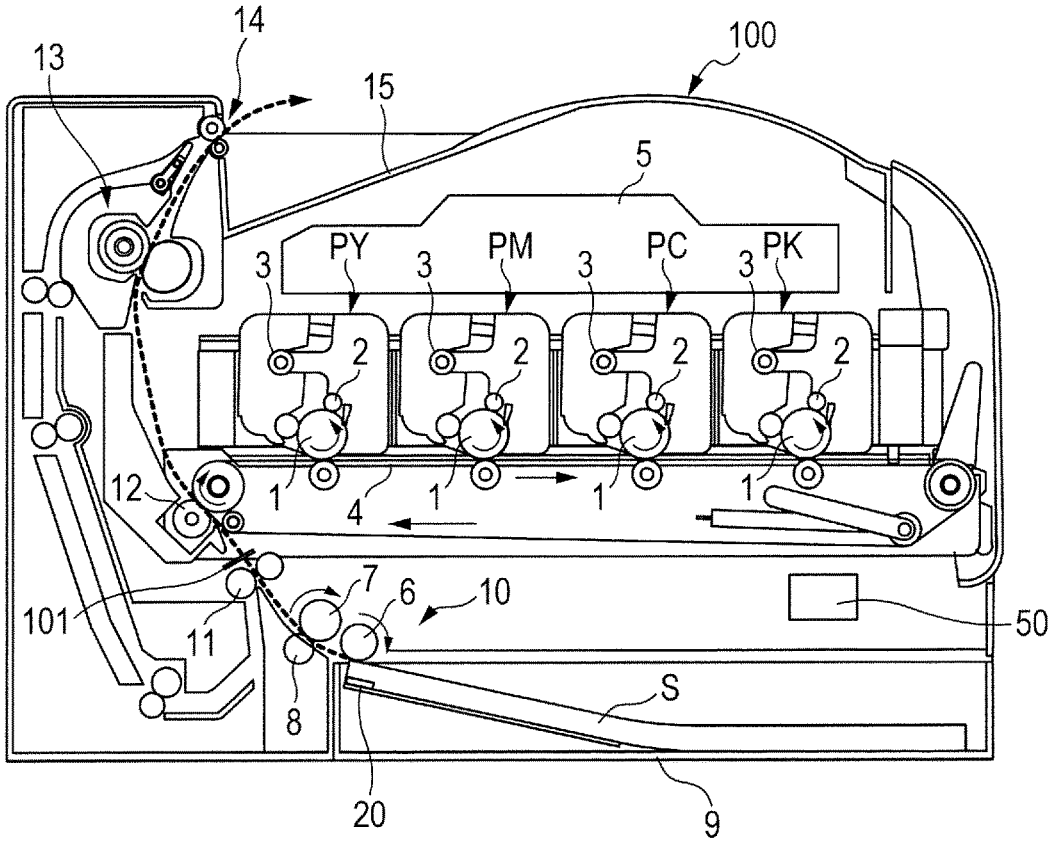
FIG. 1A is a schematic sectional view of an image forming apparatus according to first to third embodiments of the present invention.

With reference to FIG. 1A, an overall configuration of a color image forming apparatus (hereinafter referred to as "image forming apparatus") 100 according to a first embodiment of the present invention is described. FIG. 1A is a schematic sectional view of the image forming apparatus 100 including a sheet feeding control mechanism. The image forming apparatus 100 is a full four-color laser printer employing an electrophotographic process. The image forming apparatus 100 forms an image on a sheet S as a recording material based on an image signal input to a control unit 50, which serves as a controller of the image forming apparatus, from an external host device such as a personal computer (hereinafter referred to as "PC"). When the control unit 50 receives a printing request such as the image signal from the external host device such as the PC, the start of the image forming operation is instructed to an image forming unit, a fixing device, a sheet feeding control unit, and the like. Further, the control unit 50 includes a ROM and a RAM. The ROM stores data and a control program to be executed by the control unit 50, and the RAM is a memory to be used when the control program executed by the control unit 50 temporarily stores information. Further, the control unit 50 has a timer function for measuring time.

In the image forming apparatus 100, in order to form a full-color image on the sheet S, the following control operation is executed. First, photosensitive drums of respective four process cartridges (hereinafter referred to as "cartridges") PY, PM, PC, and PK, which serve as image forming units, are rotationally driven in a counterclockwise direction (direction of the arrows in FIG. 1A) at a predetermined control speed. The cartridge PY contains yellow toner, the cartridge PM contains magenta toner, the cartridge PC contains cyan toner, and the cartridge PK contains black toner. A belt 4 serving as an intermediate transfer member is also rotationally driven in a clockwise direction, which is indicated by the arrows in FIG. 1A, at a speed corresponding to the speed of the photosensitive drum 1. Further, a scanner unit 5 for forming an electrostatic latent image on the photosensitive drum 1 is also driven.

In each of the cartridges PY, PM, PC, and PK, a charging roller 2 uniformly charges the surface of the photosensitive drum 1 to a predetermined polarity and potential at a predetermined control timing. Subsequently, the scanner unit 5 scans and exposes the surface of the photosensitive drum 1 of each of the cartridges PY, PM, PC, and PK with laser light modulated in accordance with the image signal of each color. With this, in a region of the surface of each photosensitive drum 1, which is scanned and exposed with the laser light, an electrostatic latent image corresponding to the image signal is formed. Then, the electrostatic latent image formed on the surface of each photosensitive drum 1 is developed with toner in a developing device 3, to thereby form a toner image. Through the above-mentioned image forming process operation, the toner image is formed on the photosensitive drum 1, and the toner images of the respective cartridges PY, PM, PC, and PK are transferred in a superimposed manner onto the belt 4 that is rotationally driven at a speed corresponding to the speed of the photosensitive drum 1.

On the other hand, in a sheet feeding device 10 for conveying the sheet S, a sheet feeding roller 6 and a sheet conveyance roller 7 are driven. The sheet feeding roller 6 is configured to come into contact with the sheet S placed on a plate 16 (described later) of a sheet feeding cassette 9 at a predetermined control timing, to thereby feed the sheet S. The sheets S as the recording media, which are stacked on the sheet feeding cassette 9, are fed by the sheet feeding roller 6, and are separated one by one by the sheet conveyance roller 7 and a separation roller 8 so as to be fed to a conveyance path. When a registration sensor 101, which serves as a detection unit for detecting the arrival of the sheet S, detects the leading edge of the sheet S that has passed through a registration roller pair 11 and conveyed along the conveyance path, the registration sensor 101 notifies the control unit 50 of the arrival. Then, at this time, the registration roller pair 11 adjusts the conveyance speed of the sheet S so that the toner images transferred onto the belt 4 and the sheet S conveyed by the sheet conveyance roller 7 arrive at a secondary transfer nip portion at the same timing.

After that, when the sheet S is nipped and conveyed at the secondary transfer nip portion, which is a nip portion between a secondary transfer roller 12 and the belt 4, the four-color superimposed toner images formed on the belt 4 are transferred onto the sheet S. Subsequently, the sheet S is separated from the surface of the belt 4 to be conveyed to a fixing device 13, and is heated and pressurized at a fixing nip portion of the fixing device 13. Thus, the respective colors of toner images on the sheet S are mixed and fixed to the sheet S. Then, the sheet S is delivered onto a delivery tray 15 by a delivery roller pair 14. Further, in order to prevent a plurality of sheets S from being fed in an overlapping manner when the number of the sheets S stacked on the sheet feeding cassette 9 is reduced, a separation-pad 20 is arranged on the plate 16 to be described later.

[Summary of Sheet Feeding Device]

Figure 1B:
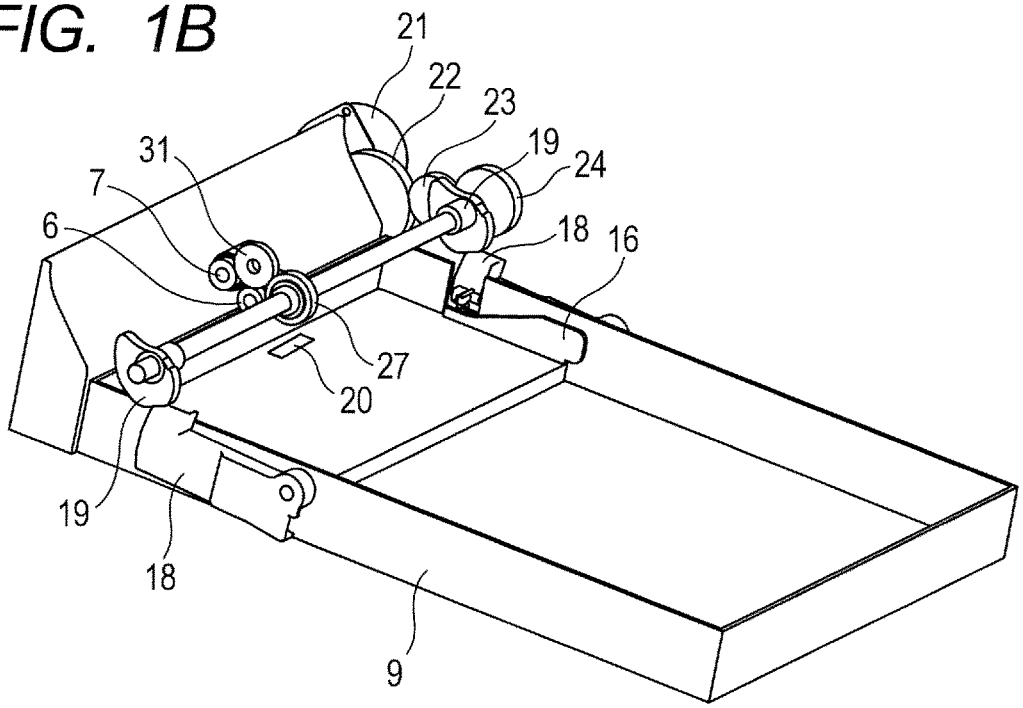
FIG. 1B is a schematic perspective view of a sheet feeding device to be used in the image forming apparatus according to the first to third embodiments.

Next, the configuration of the sheet feeding device 10 is described. FIG. 1B is a schematic perspective view of the sheet feeding device. The sheet feeding device 10 includes the sheet feeding cassette 9 for stacking the sheets S thereon, a lift mechanism for lifting the plate 16 up and down, and a path for transmitting the rotational drive from a stepping motor 21, which serves as a driving unit, to the sheet feeding roller 6 and the sheet conveyance roller 7. The sheet feeding device 10 of this embodiment does not include a sheet detection unit such as a sensor function for detecting present or absence of the sheet S placed on the plate 16 or a sensor function for determining the type of the sheet placed on the sheet feeding cassette 9. Note that, reference symbols in FIG. 1B are described later.

[Sheet Feeding Cassette]

Figure 2A:
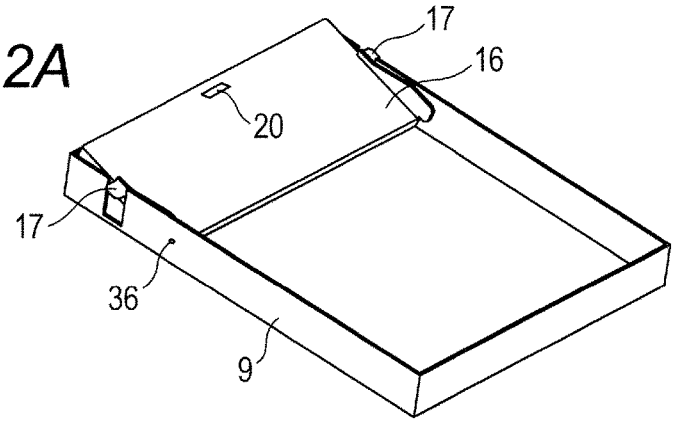
FIG. 2A is a schematic perspective view of a sheet feeding cassette of the sheet feeding device of FIG. 1B.

First, with reference to FIGS. 2A to 2D, the sheet feeding cassette 9 is described. FIG. 2A is a schematic perspective view of the sheet feeding cassette 9. The sheet feeding cassette 9 is configured to be mounted in a freely removable manner from the front side of the image forming apparatus 100, which corresponds to a right side surface of the image forming apparatus 100 illustrated in FIG. 1A, thereby enabling the user to easily place the sheets S and carry out jam recovery. As illustrated in FIG. 2A, the sheet feeding cassette 9 includes the plate 16 on which the sheet S is to be placed. The plate 16 carries out a rising operation to be described later so as to urge the sheet S to the sheet feeding roller 6. The plate 16 is positioned in a freely rotatable manner about a rotation center 36 of the plate. Further, at both ends of the plate 16, engaging portions 17 are formed for lift levers 18 for controlling the lifting operation of the plate 16.

[Lift Mechanism for Plate]

Figure 2B:
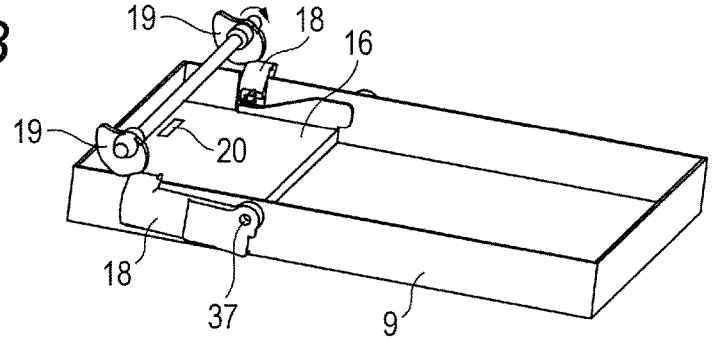
FIG. 2B and FIG. 2C are schematic perspective views illustrating states of a plate of the sheet feeding cassette of FIG. 2A.
Figure 2C:
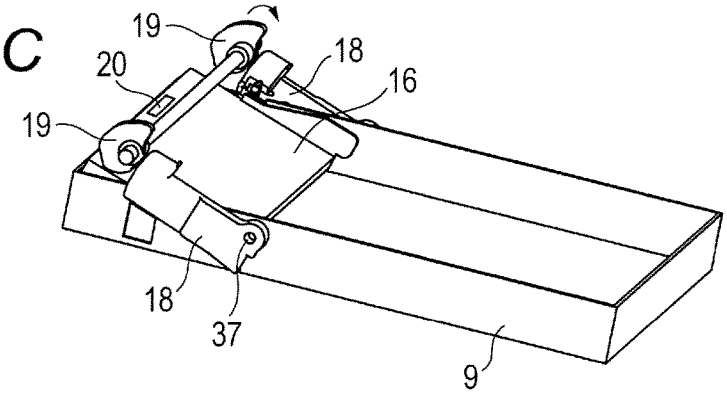

Subsequently, the lift mechanism for the plate 16 is described. FIG. 2B is a schematic perspective view illustrating a state in which the plate 16 is most separated from the sheet feeding roller 6 (not shown) (lowermost state), and FIG. 2C is a schematic perspective view illustrating a state in which the plate 16 is moved up to come into contact with the sheet feeding roller 6 (not shown) (uppermost state). On the main body side of the image forming apparatus 100, as illustrated in FIGS. 2B and 2C, the lift levers 18 are each positioned in a freely rotatable manner about a rotation center 37 of the lift lever. The lift levers 18 are urged in the direction of the sheet feeding roller 6 by an urging member (not shown). Under a state in which the sheet feeding cassette 9 is mounted to the image forming apparatus 100, the above-mentioned engaging portions 17 of the plate 16 engage with the lift levers 18 so that the plate 16 is also movable up and down in association with the lifting operation of the lift levers 18.

Further, the rising operation of the lift levers 18 urged in the direction of the sheet feeding roller 6 is regulated by plate lifting control cams 19 (hereinafter referred to as "control cams 19") arranged above the lift levers 18. As illustrated in FIGS. 2B and 2C, when the control cams 19 are rotated, the lift levers 18 move up and down, and thus the plate 16 moves up and down via the engaging portions 17 for the lift levers. That is, from the state in which the plate 16 is completely moved down as illustrated in FIG. 2B, the control cams 19 are rotated in the arrow direction in FIG. 2B so that the plate 16 is urged in the direction of the sheet feeding roller 6 by the urging member (not shown). Thus, the plate 16 is moved up along the shape of the control cams 19 to be moved to the position illustrated in FIG. 2C. When the control cams 19 are further rotated, the lift levers 18 are pressed downward in FIG. 2C by the control cams 19, and thus the plate 16 is moved in a direction to separate from the sheet feeding roller 6, to thereby return to the state illustrated in FIG. 2B.

The lifting operation of the plate 16 is repeated for each sheet S, and the sheet S placed on the plate 16 is controlled by the rotating operation of the control cams 19 so as to be arranged between a position at which the sheet S is brought into contact with and urged to the sheet feeding roller 6 and a position at which the sheet S is separated from the sheet feeding roller 6. Further, the separation-pad 20 is arranged on the plate 16 so as to prevent duplicated sheet-feeding of the lowermost sheet S, which is caused when the lowermost sheet S is dragged by the pick-up operation of the uppermost stacked sheet S carried out by the sheet feeding roller 6, when the number of the sheets S placed on the plate 16 is reduced. Note that, the separation-pad 20 is arranged at a position opposed to the sheet feeding roller 6 as illustrated in FIGS. 2A to 2D.

[Drive Transmission Path]

Figure 2D:
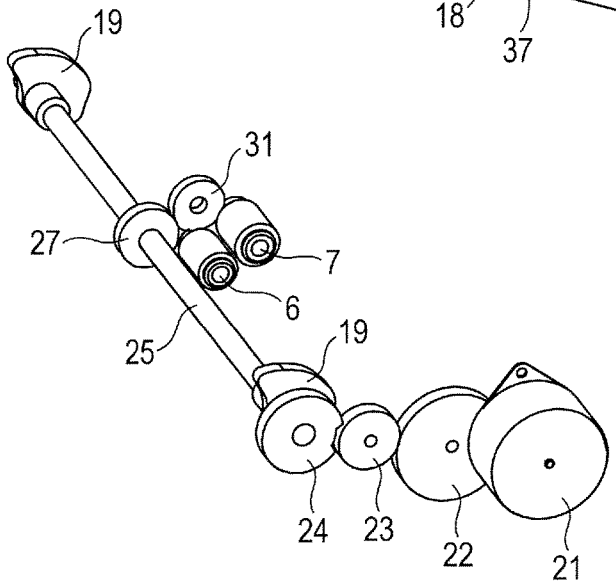
FIG. 2D is a schematic perspective view of a drive transmission path of the sheet feeding device of FIG. 1B.

Next, with reference to FIG. 2D, the drive transmission path in which the rotation of the driving unit is transmitted to the sheet feeding roller 6 and the sheet conveyance roller 7 is described. FIG. 2D is a schematic perspective view illustrating the drive transmission path according to this embodiment. The image forming apparatus 100 includes the stepping motor 21 serving as the driving unit. The stepping motor 21 is driven through control from the control unit 50, and the rotational drive of the stepping motor 21 is transmitted from a first drive gear 22 to a second drive gear 23. Note that, a partially toothed gear 24 is controlled by a solenoid (not shown), and is configured to selectively mesh with the second drive gear 23. In this embodiment, the meshing between the partially toothed gear 24 and the second drive gear 23 is controlled by the solenoid, but the meshing may be controlled with use of an electromagnetic clutch or the like, for example. Further, the partially toothed gear 24 and the control cams 19 are fixed to the same rotation shaft 25 so as to be integrally rotated. That is, when the solenoid is operated based on the control signal from the control unit 50, the partially toothed gear 24 meshes with the second drive gear 23, and the drive of the stepping motor 21 rotates, via the partially toothed gear 24, the control cams 19 fixed to the same rotation shaft 25.

Further, a gear 27 is also fixed to the rotation shaft 25 to which the partially toothed gear 24 and the control cams 19 are fixed. When the gear 27 is rotated, a gear 31 meshing with the gear 27 is also rotated. Tooth surfaces that mesh with the gear 31 are formed at end portions of the sheet feeding roller 6 and the sheet conveyance roller 7. In response to the rotation of the gear 31, the sheet feeding roller 6 and the sheet conveyance roller 7 are rotationally driven. In this case, the conveyance distance of the sheet S by the sheet feeding roller 6 and the sheet conveyance roller 7 is set so that the sheet S can be conveyed to the registration roller pair 11 on the downstream of the conveyance path by the rotating operation of the partially toothed gear 24 and the control cams 19.

As described above, the stepping motor 21 and the control cams 19 are interlocked with each other. Through one rotation of the control cams 19, the plate 16 can come into contact with or separate from the sheet feeding roller 6. Therefore, when the stepping motor 21 falls out of step at a position at which the plate 16 is urged to the sheet feeding roller 6, even if the user resets the sheet S, the plate 16 is brought into contact with the sheet feeding roller 6, and hence the leading edge of the sheet S does not enter the gap between the plate 16 and the sheet feeding roller 6. Therefore, the sheet cannot be placed at a normal position in the sheet feeding roller 6.

More specifically, the levers 18 are arranged on the main body side of the apparatus 100. Therefore, when the cassette 9 is removed from the main body, the engaging portions 17 and the levers 18 are disengaged so that the plate 16 is in the lowermost state. Therefore, the user can place the sheet S on the plate 16. However, when the cassette 9 is mounted to the main body again in this state, the levers 18 on the main body side are still in the moved-up state, and hence the plate 16 is moved up before the leading edge of the sheet S enters the gap between the plate 16 and the roller 6. Therefore, the leading edge of the sheet S collides with the roller 6. Thus, the user cannot place the sheet S at the normal position in the roller 6.

[Control Sequence of Feeding Operation]

Figure 3:
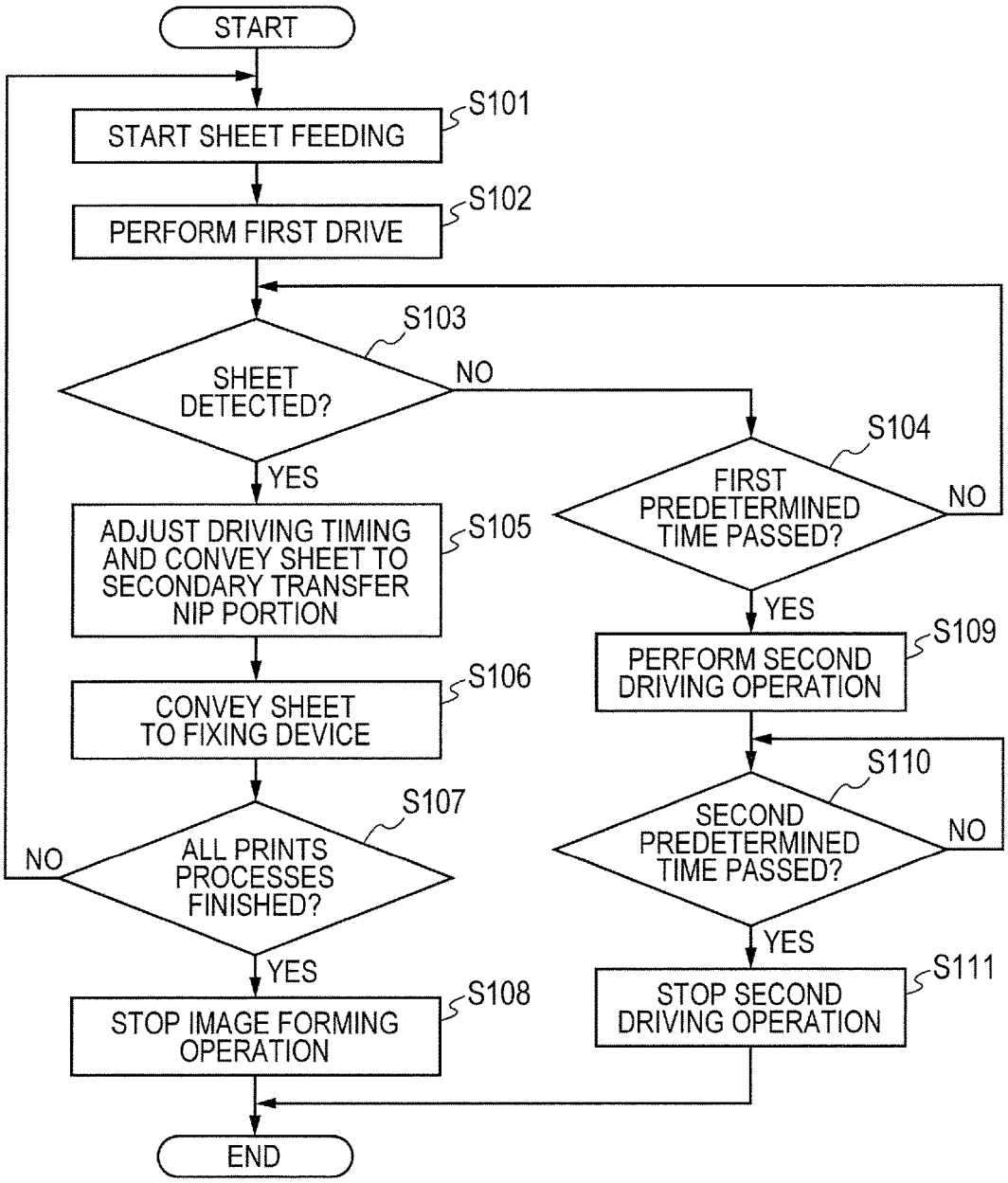
FIG. 3 is a flow chart illustrating a control sequence of the first embodiment.

Next, with reference to the flow chart of FIG. 3, a feeding operation of this embodiment is described. FIG. 3 is a flow chart illustrating a control sequence of the feeding operation according to this embodiment. The processing illustrated in FIG. 3 is executed by the control unit 50 when the printing request is received from the external host device such as the PC. First, in Step S101 (hereinafter simply referred to as "S101"), the control unit 50 instructs the image forming unit, the fixing device, the sheet feeding control unit, and the like to start the image forming operation. Further, the timer is reset and started.

In S102, the stepping motor 21 instructed to start the image forming operation from the control unit 50 starts accelerated rotation at a feeding operation start timing, to thereby rotate, via the partially toothed gear 24, the control cams 19 fixed to the same rotation shaft as the partially toothed gear 24. As described above, when the control cams 19 are rotated, the lift levers 18 rise, and the plate 16 also starts to rise via the engaging portions 17 for the lift levers 18. When the plate 16 having the sheets S stacked thereon carries out the rising operation, the uppermost sheet S on the plate 16 is brought into contact with the sheet feeding roller 6. Further, in response to the rotation of the gear 31, which is rotationally driven by the gear 27 on the same rotation shaft as the control cams 19, the sheet feeding roller 6 and the sheet conveyance roller 7 are rotationally driven. Such a normal feeding operation of the sheet feeding device 10 is hereinafter referred to as "first driving operation". Then, the sheets S as the recording media stacked on the plate 16 of the sheet feeding cassette 9 are fed by the sheet feeding roller 6, and are separated and fed through the conveyance path one by one by the sheet conveyance roller 7 and the separation roller 8.

In S103, the control unit 50 determines whether or not the sheet S is normally conveyed through the conveyance path based on whether or not the registration sensor 101 has received a notification of detecting the sheet S. When the control unit 50 receives the notification of detecting the leading edge of the sheet S from the registration sensor 101, the control unit 50 determines that the sheet S is normally conveyed through the conveyance path, and the processing proceeds to S105. When no notification is received, the processing proceeds to S104. In S104, the control unit 50 reads the timer value from the timer, and determines whether or not a first predetermined time has passed, which is a time from the start of the feeding of the sheet S to the arrival of the sheet S to the registration sensor 101. When the control unit 50 determines that the first predetermined time has not passed, the processing returns to S103, and when the control unit 50 determines that the first predetermined time has passed, the processing proceeds to S109.

In S105, the control unit 50 controls the registration roller pair 11 for conveying the sheet S to adjust the conveyance speed of the sheet S so that the toner images transferred onto the belt 4 match with the transfer position on the fed sheet S. Then, when the adjustment is completed, the control unit 50 causes the sheet S to be conveyed to the secondary transfer nip portion so as to transfer the toner images on the belt 4 onto the sheet S. In S106, the control unit 50 causes the sheet S having the toner images transferred thereon to separate from the belt 4 so as to be conveyed to the fixing device 13. The control unit 50 controls the fixing device 13 to carry out processing of heating and pressurizing the sheet S at the fixing nip portion so as to fix the toner images to the sheet, and then delivers the sheet S that has finished the fixing processing outside the apparatus.

In S107, the control unit 50 determines whether or not all print processes are finished. When all print processes are not finished, the processing returns to S101, and when all print processes are finished, the processing proceeds to S108. In S108, the control unit 50 instructs the image forming unit, the fixing device, the sheet feeding control unit, and the like to stop the image forming operation, to thereby finish the processing.

Before describing the processing in S109 and subsequent steps, the operation of the stepping motor 21 when no sheet S is placed on the sheet feeding cassette 9 is described. When no sheet S is placed on the sheet feeding cassette 9, with the rising of the plate 16, the separation-pad 20 arranged on the plate 16 comes into contact with the sheet feeding roller 6 in an urged state. In order to prevent the lowermost sheet S from being dragged by the sheet S placed on the upper side even when various types of sheets are placed on the plate 16, the friction coefficient of the separation-pad 20 is set high. Therefore, when the stepping motor 21 is rotated under a state in which the separation-pad 20 is brought into contact with the sheet feeding roller 6, an excessive load is applied to the stepping motor 21 serving as the driving unit for the sheet feeding roller 6. Therefore, the stepping motor 21 may fall out of step. "Step-out" in this embodiment refers to a case where the stepping motor 21 is stopped due to the stop of the sheet feeding roller 6. That is, the "step-out" refers to a case where the stepping motor 21 is stopped due to application of an excessive load from the outside. Further, when the stepping motor 21 falls out of step, the plate 16 is stopped under a state of being urged to the sheet feeding roller 6, and hence even if the feeding of the sheet is restarted, the stepping motor 21 falls out of step again.

In view of this, when the first predetermined time has passed in S104, the control unit 50 determines that the stepping motor 21 has fallen out of step. In S109, the control unit 50 carries out a "second driving operation" of rotating the stepping motor 21 for a predetermined time at low speed rotation in a self-start-area (second speed) in order to restore the stepping motor 21 from the step-out state due to the overload. With this, the control cams 19 are rotated, and the plate 16 is moved to a position separated from the sheet feeding roller 6. Further, the control unit 50 resets the timer so as to measure a second predetermined time, which is a predetermined time for carrying out the second driving operation, and then starts the timer. In this embodiment, the second predetermined time is set to a time required to rotate the control cams 19, and return the plate 16 to a normal position that is a position most separated from the sheet feeding roller 6 (FIG. 2B). In S110, the control unit 50 reads the timer value from the timer, and determines whether or not the second predetermined time has passed. When the second predetermined time has passed, the processing proceeds to S111, and when the second predetermined time has not passed, the processing in S110 is repeated. In S111, the control unit 50 stops the second driving operation carried out by the sheet feeding device 10, to thereby finish the processing.

[Time Chart of Feeding Operation]

Figure 4A:
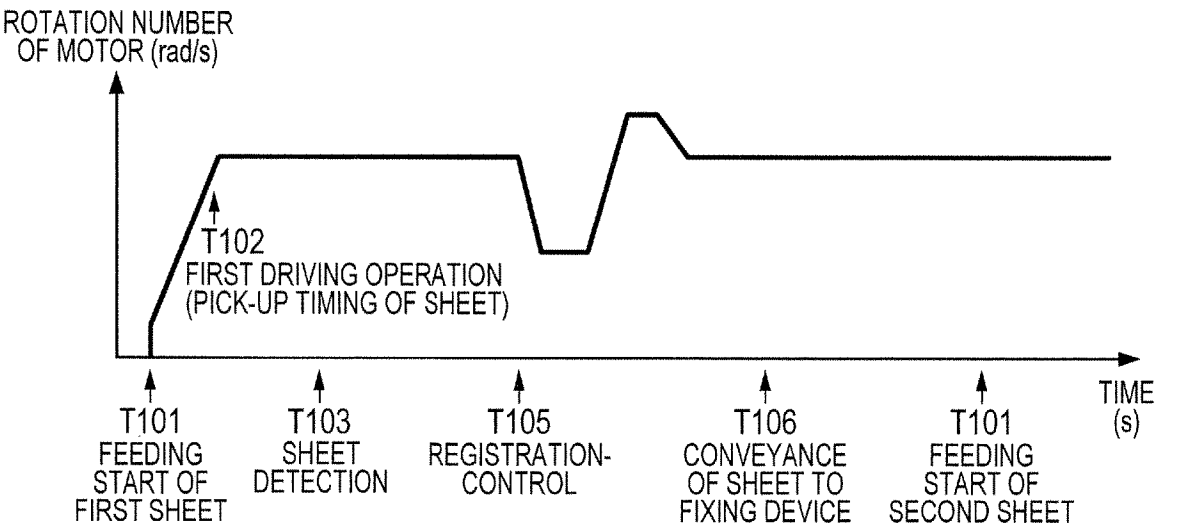
FIG. 4A is a time chart attained when a sheet is normally conveyed according to the first embodiment.
Figure 4B:
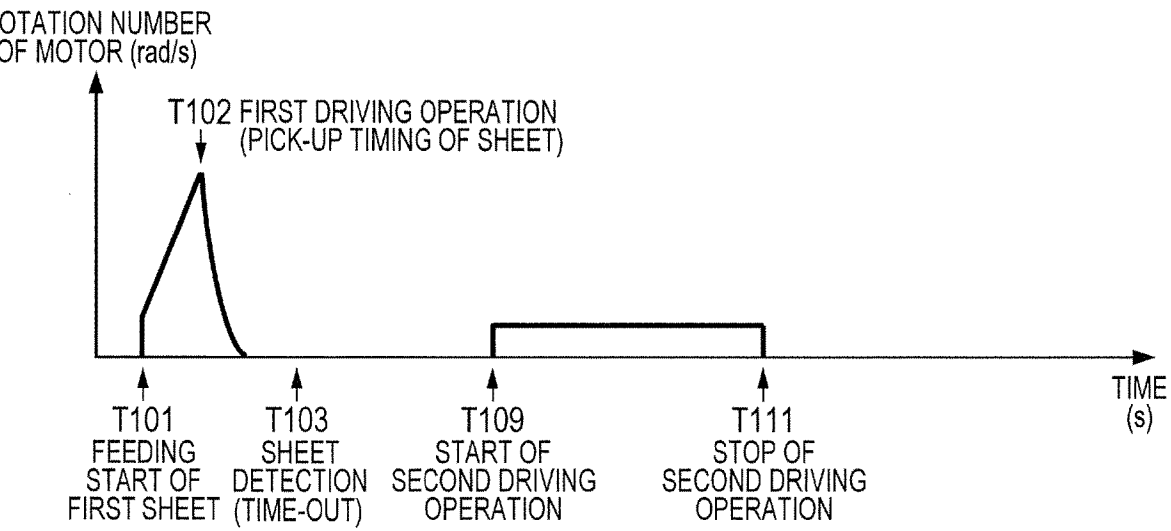
FIG. 4B is a time chart attained when a stepping motor falls out of step according to the first embodiment.

The above-mentioned driving operation of the stepping motor 21 is described in detail with reference to a time chart. FIG. 4A is a time chart for the flow chart of FIG. 3. FIG. 4A is a time chart for a case where the sheet S is placed on the sheet feeding cassette 9, and FIG. 4B is a time chart for a case where no sheet S is placed on the sheet feeding cassette 9. In FIGS. 4A and 4B, the vertical axis represents a rotation number of the stepping motor 21 (unit: rad/s (radian/second)), and the lateral axis represents time (unit: s (second)). Further, reference symbols starting from T in FIGS. 4A and 4B (such as T101) represent time timings, and the numbers in the reference symbols correspond to the step numbers starting from S, which denote the respective processing in the flow chart described with reference to FIG. 3.

In FIG. 4A, when sheet feeding is started at Time Timing T101 (hereinafter simply referred to as "T101") (S101 in FIG. 3), the rotation number of the stepping motor is increased. Then, when the start timing of the feeding operation (pick-up timing of the sheet S) arrives at T102, the first driving operation is performed (S102 in FIG. 3), to thereby drive the stepping motor 21 in a high rotational speed area and feed the sheet S. When the registration sensor 101 detects the leading edge of the sheet S at T103 (YES in S103 in FIG. 3), the registration roller pair 11 for conveying the sheet S adjusts the conveyance speed of the sheet S (S105 in FIG. 3). Then, when the adjustment is completed, at T105, the sheet S is conveyed to the secondary transfer nip portion (S105 in FIG. 3). At T106, the sheet S having the toner images transferred thereon is conveyed to the fixing device 13, and the sheet S is subjected to processing of fixing the toner images to the sheet. The sheet S that has finished the fixing processing is delivered outside the apparatus. Then, feeding of the second sheet S is started (S101 in FIG. 3).

Subsequently, the time chart of FIG. 4B is described. The image forming apparatus 100 according to this embodiment does not include a sensor for determining presence or absence of the sheet on the sheet feeding cassette 9, and hence even in a state in which no sheet S is placed on the sheet feeding cassette 9, similarly to FIG. 4A, the first driving operation is carried out at T101 (S101 in FIG. 3). As a result, even when the separation-pad 20 is brought into contact with the sheet feeding roller 6 so that the stepping motor 21 enters an overload state, the stepping motor 21 maintains the high-speed operation. In the case of printing of the first sheet from the start of the printing, as indicated at the start timing of the feeding operation in FIG. 4B (T102), the stepping motor 21 enters the overload state in the process of acceleration of the rotational speed of the stepping motor (pick-up timing without the sheet S). Further, when the sheet runs out during the printing of the second sheet S or subsequent sheets from the start of printing, under a state of a constant speed (first speed) after conveyance to the fixing device (T106 in FIG. 4A), the stepping motor 21 enters the overload state when the sheet feeding roller 6 picks up the next sheet. The stepping motor 21 is uncontrollable if, under a state in which the motor rotation is accelerated, the stepping motor 21 falls out of step due to the overload state, and the stepping motor 21 cannot be restored from the step-out state even after the feeding operation is finished. Even if the user tries reprinting and repeats the feeding start (S101 in FIG. 3), under a state in which the separation-pad 20 is brought into contact with the sheet feeding roller 6, the stepping motor 21 falls out of step again. Further, even if the user resets the sheet S on the sheet feeding cassette 9 under a state in which the plate 16 is stopped at a position at which the plate 16 is urged to the sheet feeding roller 6, the leading edge in the conveyance direction of the sheet S does not enter the gap between the plate 16 and the sheet feeding roller 6, which causes a jam.

Therefore, in FIG. 4B, the stepping motor 21 falls out of step at T102 because no sheet S is placed. As a result, no sheet S is conveyed, and hence the registration sensor 101 does not detect the sheet S at T103, which is the timing after passage of the first predetermined time from T101 (time-out) (YES in S104 in FIG. 3). Therefore, the second driving operation is started at T109 (S109 in FIG. 3). As described above, the second driving operation refers to an operation of rotating the stepping motor 21 at low speed rotation in the self-start-area. The self-start-area of the stepping motor is a general basic characteristic of the stepping motor, and herein means the initial speed of the stepping motor, which enables activation in synchronization with a pulse signal input from the outside to the stepping motor. Then, when the second predetermined time during which the second driving operation is carried out has passed, the second driving operation is stopped at T111, and the plate 16 enters a state of being stopped at a position most separated from the sheet feeding roller 6 (FIG. 2B).

Even if the stepping motor falls out of step, the stepping motor is driven in the self-start-area, to thereby be rotationally activated again in synchronization with the pulse signal input from the outside. Therefore, the stepping motor can come out of a state of being applied with an excessive load due to the contact between the separation-pad 20 and the sheet feeding roller 6. Further, in general, the output torque of the motor is higher at low speed rotation than at high speed rotation. Therefore, when the stepping motor 21 carries out the low speed rotation in the self-start-area, the separation-pad 20 and the sheet feeding roller 6 can be restored to the separating state from the contact state causing the overload state of the stepping motor 21.

As described above, according to this embodiment, in an apparatus using a low-output stepping motor, the plate can be restored to a normal state from a state of being urged to the sheet feeding roller. Even when the user forgets to set the sheet on the sheet feeding cassette, such a state that the plate stops in a state of being urged to the sheet feeding roller, which inhibits placement of the sheet, is avoided. Further, an inexpensive stepping motor in which the output necessary for the feeding operation is suppressed low can be mounted, and hence reduction in cost can be realized.

Further, in this embodiment, the configuration in which the separation-pad 20 is arranged on the plate 16 is assumed. However, the separation-pad 20 is not necessarily arranged. The present invention is also applicable to a configuration in which the stepping motor 21 falls out of step also when the sheet feeding roller 6 is brought into contact with a position having a lower friction coefficient as compared to the separation-pad 20.

Further, in this embodiment, the control carried out when no sheet S is stacked on the cassette 9 is described, but the present invention is applicable also to a case where the sheet S is caught (referred to as "jammed") in the conveyance path from the cassette 9 to the registration sensor 101. The plate 16 is moved down when the sheet S is jammed, to thereby attain an effect in that the user can easily carry out the jam recovery.

Further, in this embodiment, the plate 16 is moved down to a state in which the plate 16 is most separated from the sheet feeding roller 6, but the plate 16 may be moved down to such an extent that the stepping motor can come out of the step-out state and at least one sheet S can be received.

Second Embodiment

In the first embodiment, the following configuration has been described. When no sheet is placed on the sheet feeding cassette, the stepping motor falls out of step due to the contact between the sheet feeding roller and the separation-pad. Therefore, the second driving operation is carried out for a predetermined time, to thereby separate the sheet feeding roller and the separation-pad from each other. In a second embodiment of the present invention, the second driving operation of a case where the stepping motor falls out of step because the user sets to print a sheet different in type from the sheet placed on the sheet feeding cassette is described. Note that, also in this embodiment, the image forming apparatus 100 and the sheet feeding device 10 described with reference to FIGS. 1A. 1B, 2A, 2B, 2C and 2D of the first embodiment are used. The same configurations as those in the first embodiment are denoted by the same reference symbols, and description thereof is omitted herein.

[Control Sequence of Feeding Operation]

Figure 5:
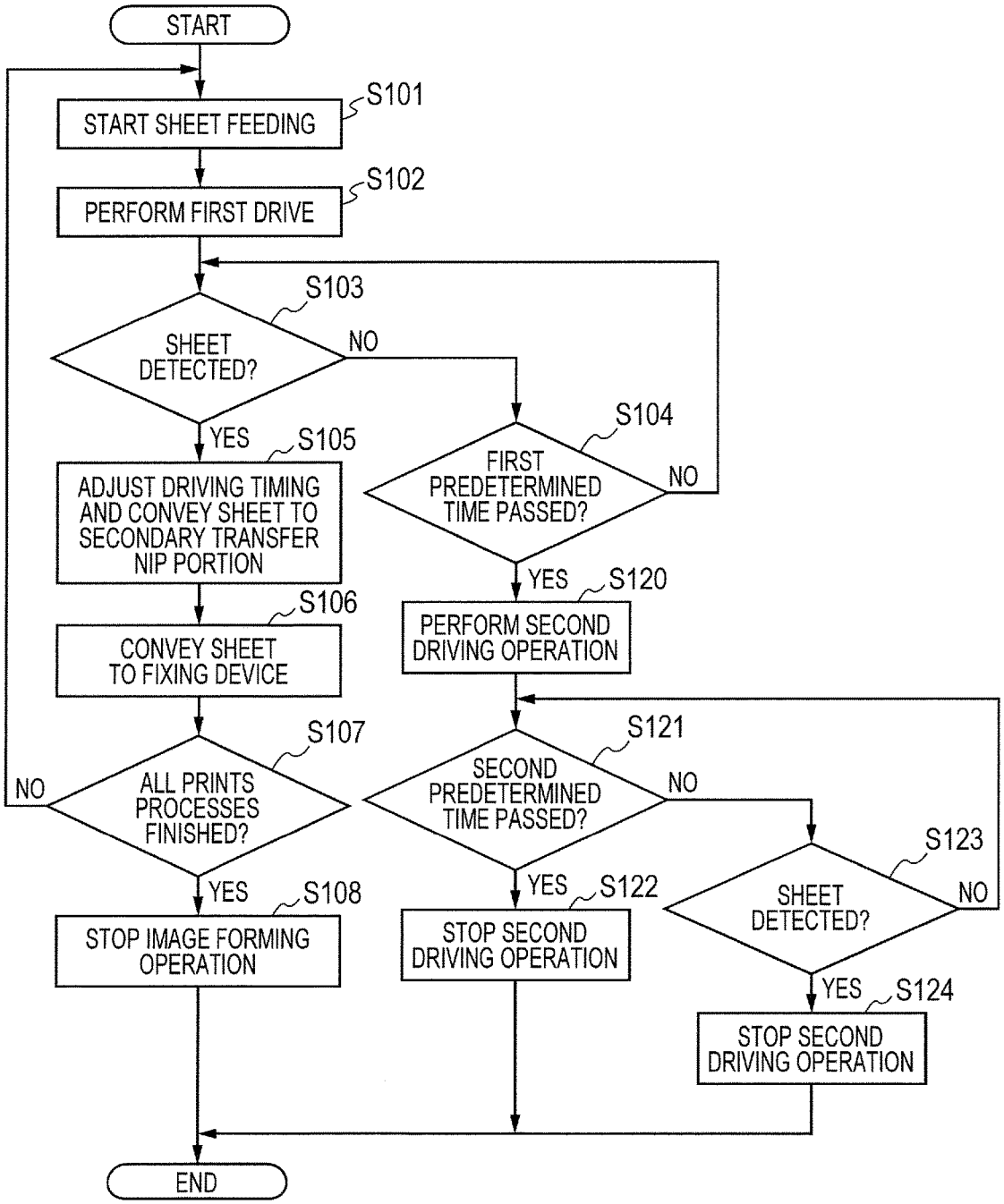
FIG. 5 is a flow chart illustrating a control sequence of the second embodiment.

First, with reference to the flow chart of FIG. 5, a feeding operation of this embodiment is described. FIG. 5 is a flow chart illustrating a control sequence of the feeding operation according to this embodiment. The processing illustrated in FIG. 5 is executed by the control unit 50 when the printing request is received from the external host device such as the PC. Note that, in FIG. 5, the same processing as the processing illustrated in FIG. 3 of the first embodiment is denoted by the same step number.

Figure 6A:
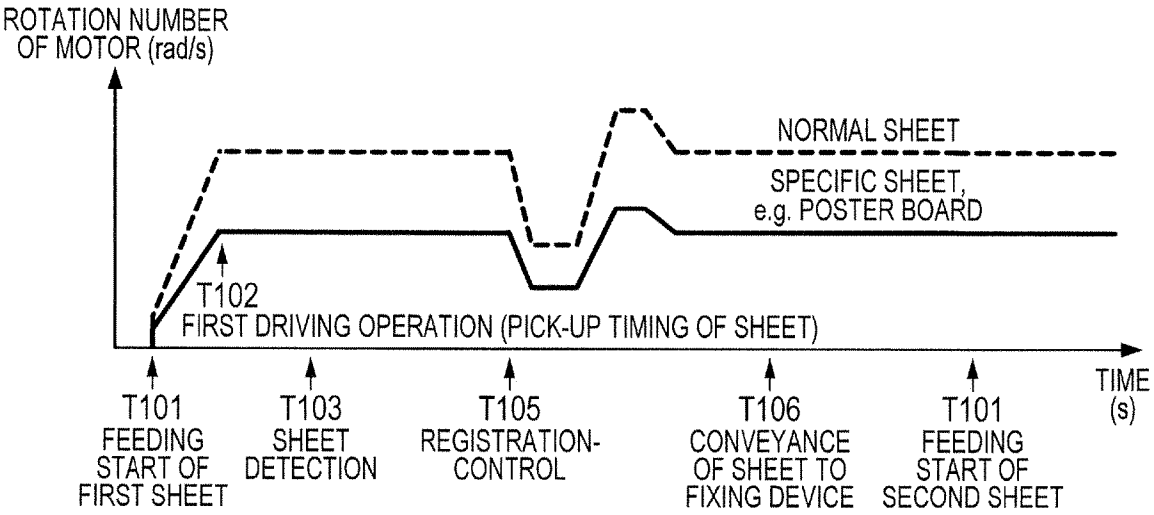
FIG. 6A is a time chart attained when the sheet is normally conveyed according to the second embodiment.

In FIG. 5, in S101 to S108, which correspond to processing in a case where the sheet S is normally conveyed for printing, the processing described with reference to FIG. 3 of the first embodiment is carried out, and hence description thereof is herein omitted. In this embodiment, the second driving operation in the case where the user sets to print a sheet of a type different from the type of the sheet S placed on the sheet feeding cassette is described. For example, as illustrated in FIG. 6A to be described later, a sheet of a specific type, such as a poster board, needs to be subjected to the fixing operation and the feeding operation at low speed in order to enhance the fixing performance of the toner images of the respective colors in the fixing device 13. In this case, the sheet S is fed while being curved around the sheet conveyance roller 7 at a conveyance speed lower than that in the normal case along the conveyance path to the registration roller pair 11. However, when the user sets the sheet placed on the sheet feeding cassette 9 as a normal sheet, the sheet such as the poster board placed on the sheet feeding cassette 9 is fed at a high conveyance speed. Therefore, the sheet made of a hard material, such as the poster board, applies an excessive load to the sheet feeding roller 6 and the like, and thus an excessive load is applied to the stepping motor 21 serving as the driving unit for the sheet feeding roller 6. In this state, the stepping motor 21 falls out of step. The stepping motor 21 falls out of step due to the excessive load, and hence the sheet S is caught on the conveyance path without being conveyed. Therefore, even when the first predetermined time has passed from the feeding start, the registration sensor 101 does not detect the leading edge of the sheet S (YES in S104).

In view of this, in S120, similarly to the first embodiment, the control unit 50 carries out the second driving operation of rotating the stepping motor 21 for the predetermined time at low speed rotation in the self-start-area. Further, the control unit 50 resets the timer so as to measure the second predetermined time, which is a predetermined time for carrying out the second driving operation, and then starts the timer. In S121, the control unit 50 reads the timer value from the timer, and determines whether or not the second predetermined time has passed. When the second predetermined time has passed, the processing proceeds to S122, and when the second predetermined time has not passed, the processing proceeds to S123. In S122, the control unit 50 stops the second driving operation carried out by the sheet feeding device 10, to thereby finish the processing. At this time, similarly to the first embodiment, the plate 16 enters a state of being stopped at a position most separated from the sheet feeding roller 6 (FIG. 2B).

In S123, the control unit 50 determines whether or not the stepping motor 21 has come out of the step-out state and the sheet S is normally conveyed through the conveyance path based on whether or not the control unit 50 has received a notification of detecting the sheet S from the registration sensor 101. That is, in this embodiment, the feeding processing is carried out by the sheet feeding device 10 at a conveyance speed not corresponding to the type of the sheet S, and hence the sheet S is stopped on the conveyance path due to the step-out of the stepping motor 21. However, in this embodiment, with the second driving operation, the stepping motor 21 is driven at low speed rotation, to thereby come out of the step-out state. Thus, the sheet feeding roller 6 and the sheet conveyance roller 7 are driven, to thereby restart the conveyance of the sheet S. As a result, the sheet S is conveyed along the conveyance path, and the sheet S passes through the registration roller pair 11. Thus, the registration sensor 101 detects the leading edge of the sheet S. When the control unit 50 does not receive the notification of detecting the leading edge of the sheet S from the registration sensor 101, the processing is returned to S121. When the control unit 50 receives the notification, the control unit 50 determines that the stepping motor 21 has been restored from the step-out state and the sheet S has normally conveyed. Then, the processing proceeds to S124.

In S124, the control unit 50 stops the second driving operation carried out by the sheet feeding device 10, to thereby finish the processing. At this time point, the second predetermined time has not passed, and hence the second driving operation is stopped in the middle of the operation of separating the plate 16 from the position at which the sheet feeding roller 6 is brought into contact with the sheet S (during the process in which the plate 16 is moved down). Therefore, this control differs from the control described in the first embodiment in which the control cams 19 are continuously rotated one revolution for the second predetermined time so that the plate 16 is returned to the position most separated from the sheet feeding roller 6 (FIG. 2B). The plate 16 is not moved down to a position sufficiently separated from the sheet feeding roller 6, and hence the user may not be able to fully load the sheets on the sheet feeding cassette 9. However, although in the middle of the second driving operation, the operation of the stepping motor 21 is stopped at the timing at which the registration sensor 101 detects the sheet S, and hence a situation where the sheet S is conveyed downstream of the conveyance path with respect to the registration sensor 101 can be avoided. In S120, when the second driving operation is started, driving of the fixing device 13 and the like relating to image formation are stopped. In this case, when the sheet S is conveyed on the downstream side of the conveyance path with respect to the registration sensor 101, the sheet S is caught in the vicinity of the fixing device 13 where the jam recovery is difficult. Therefore, it is desired to avoid the situation where the sheet S is conveyed on the downstream side of the conveyance path with respect to the registration sensor 101. As described above, the sheet S is stopped in the vicinity of the registration sensor 101, and hence the jam recovery work by the user can be facilitated as compared to the case where the jam recovery is carried out on the downstream of the conveyance path.

[Time Chart of Feeding Operation]

Figure 6B:
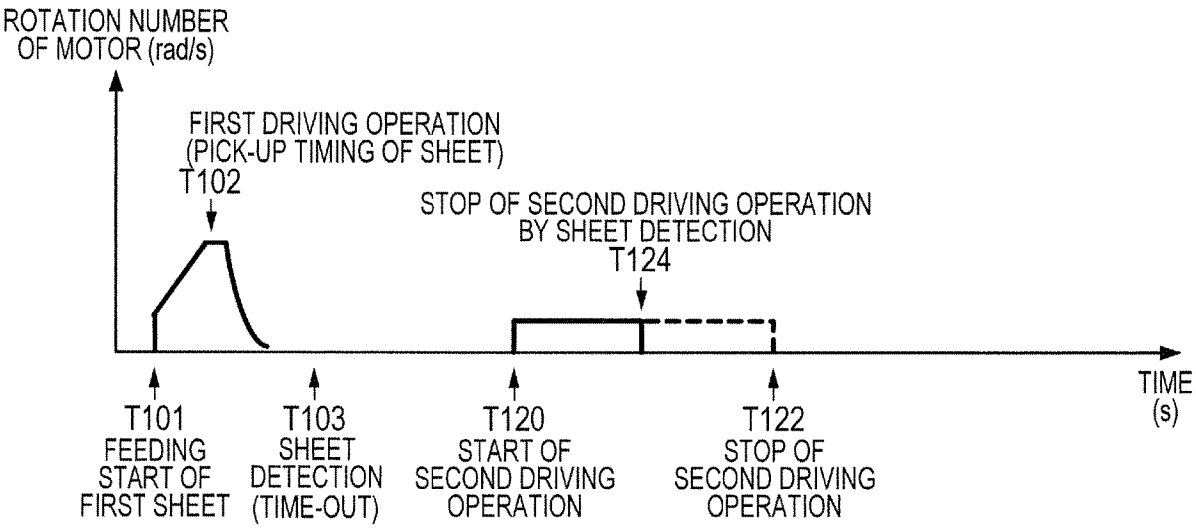
FIG. 6B is a time chart attained when the stepping motor falls out of step according to the second embodiment.

The above-mentioned driving operation of the stepping motor 21 is described with reference to a time chart. FIGS. 6A and 6B are time charts for the flow chart of FIG. 5. FIG. 6A is a time chart for a case where the sheet S of a proper type is placed on the sheet feeding cassette 9, and FIG. 6B is a time chart for a case where the sheet S of a type different from a designated type of the sheet is placed on the sheet feeding cassette 9. In FIGS. 6A and 6B, the vertical axis represents the rotation number of the stepping motor 21 (unit: rad/s (radian/second)), and the lateral axis represents time (unit: s (second)). In FIG. 6A, the rotation number of the stepping motor 21 in the case of a normal sheet is represented by the broken line, and the rotation number in the case of a specific sheet such as a poster board is represented by the solid line. As illustrated in FIG. 6A, it is understood that, when the sheet S is the poster board, as compared to the normal sheet, the rotation number of the stepping motor 21 is suppressed so that the conveyance operation is carried out at a lower conveyance speed. Note that, reference symbols starting from T in FIGS. 6A and 6B (such as T101) represent time timings, and the numbers in the reference symbols correspond to the step numbers starting from S, which denote the respective processing in the flow chart described with reference to FIG. 5. The time chart of FIG. 6A is similar to the time chart illustrated in FIG. 4A described in the first embodiment except that the rotation number of the stepping motor is lower than that in the first embodiment because the sheet S is the poster board. Redundant description is omitted.

Subsequently, the time chart of FIG. 6B is described. Similarly to FIG. 6A, the first driving operation is carried out at T101 (S101 in FIG. 5), and the stepping motor 21 is operated at high speed. In the case of printing of the first sheet from the start of printing, as indicated at the start timing of the feeding operation of FIG. 6B (T102), the sheet S is conveyed for a while from the start of the feeding operation. However, the sheet S placed on the sheet feeding cassette 9 is a poster board, which is a type different from the designated normal sheet. Therefore, an excessive load is applied to the sheet feeding roller 6 and the sheet conveyance roller 7. As a result, the stepping motor 21 enters the overload state during the drive at high speed that is a predetermined rotational speed, and thus enters the step-out state. Therefore, the sheet S is stopped on the conveyance path. As a result, the registration sensor 101 does not detect the sheet S at T103, which is the timing after passage of the first predetermined time from T101 (YES in S104 in FIG. 5). Therefore, at T120, the second driving operation is started (S120 in FIG. 5).

With the second driving operation, the stepping motor 21 is driven at low speed rotation, to thereby come out of the step-out state. Thus, the sheet feeding roller 6 and the sheet conveyance roller 7 are driven, to thereby restart the conveyance of the sheet S. As a result, the sheet S is conveyed along the conveyance path, and the sheet S passes through the registration roller pair 11. Then, the registration sensor 101 detects the leading edge of the sheet S (YES in S123 in FIG. 5). At T124 at which the sheet S is detected, the second driving operation carried out by the sheet feeding device 10 is stopped (S124 in FIG. 5).

On the other hand, similarly to the first embodiment, in a case where no sheet S is placed on the sheet feeding cassette, when the predetermined time required for the second driving operation has passed (YES in S121 in FIG. 5), the second driving operation carried out by the sheet feeding device 10 is stopped at T122 (S122 in FIG. 5). At this time, similarly to the first embodiment, the plate 16 reaches a position most separated from the sheet feeding roller 6 (FIG. 2B).

In this embodiment, at the timing at which the registration sensor 101 detects the sheet S, the operation of the stepping motor 21 is stopped. However, the relationship in order between the timing to separate the plate 16 from the sheet feeding roller 6 and the timing at which the registration sensor 101 detects the sheet S differs depending on the shape of the control cams 19, the installed position of the registration sensor 101, and the sheet feeding path. Therefore, the time to stop the second driving operation may be appropriately changed in accordance with the timing at which the registration sensor 101 detects the sheet S. As described above, according to this embodiment, in the apparatus using the low-output stepping motor, the plate can be restored to a normal state from a state of being urged to the sheet feeding roller.

Third Embodiment

In the second driving operation of the stepping motor in the first and second embodiments, the rotation of the stepping motor is controlled to low speed rotation in the self-start-area. In a third embodiment of the present invention, the following embodiment is described. The current value for driving the stepping motor is increased so that the stepping motor in the second driving operation is temporarily controlled at high output. Note that, also in this embodiment, the image forming apparatus 100 and the sheet feeding device 10 described with reference to FIGS. 1A, 1B, 2A, 2B, 2C and 2D of the first embodiment are used. The same configurations as those in the first embodiment are denoted by the same reference symbols, and description thereof is omitted herein.

[Control Sequence of Feeding Operation]

Figure 7:
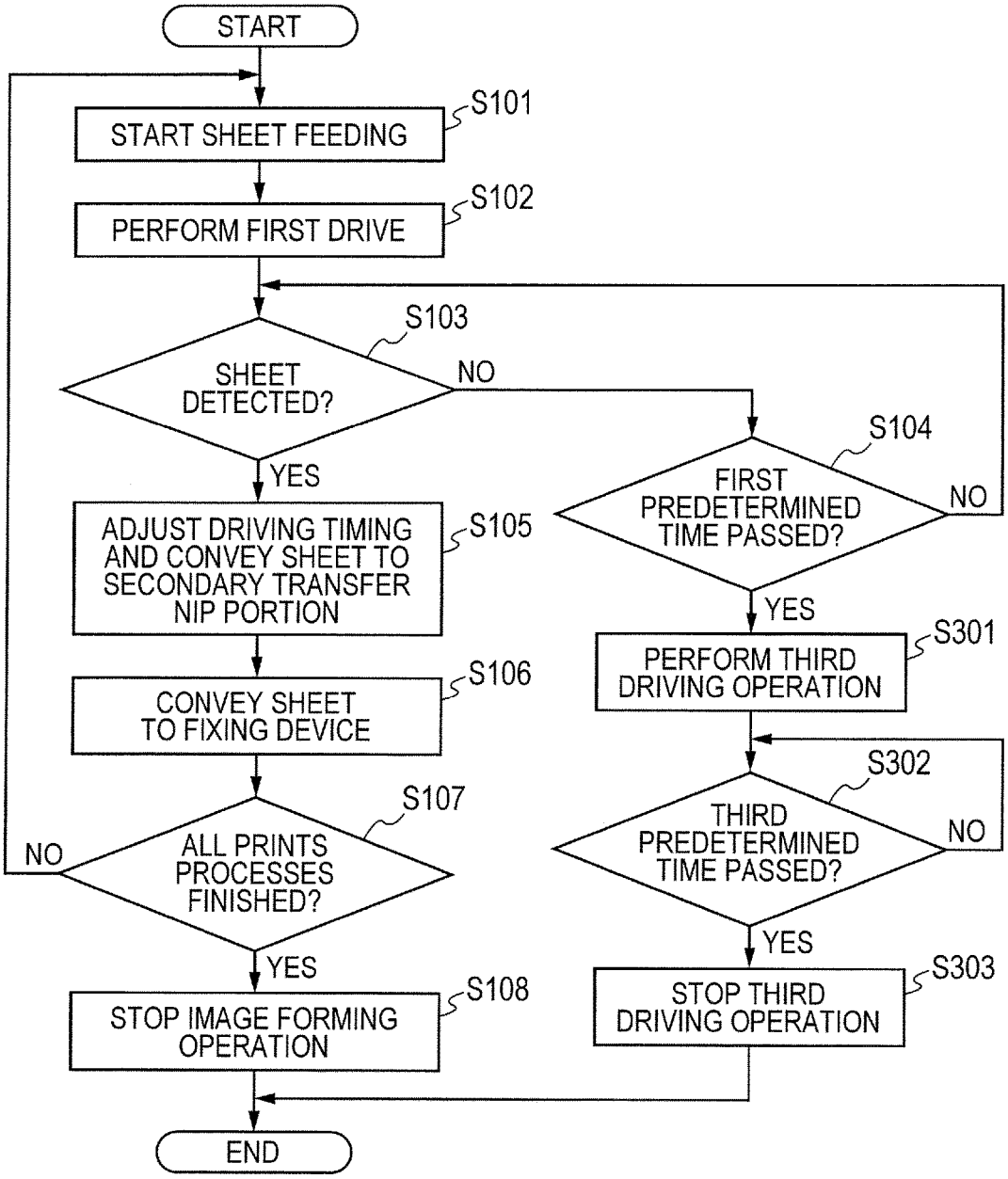
FIG. 7 is a flow chart illustrating a control sequence of the third embodiment.

With reference to the flow chart of FIG. 7, a feeding operation of this embodiment is described. FIG. 7 is a flow chart illustrating a control sequence of the feeding operation according to this embodiment. The processing illustrated in FIG. 7 is executed by the control unit 50 when the printing request is received from the external host device such as the PC. Note that, in FIG. 7, the same processing as the processing illustrated in FIG. 3 of the first embodiment is denoted by the same step number.

In FIG. 7, in S101 to S108, which correspond to processing in a case where the sheet S is normally conveyed for printing, the processing described with reference to FIG. 3 of the first embodiment is carried out, and hence description thereof is herein omitted. In S104, the control unit 50 reads the timer value from the timer, and determines whether or not the first predetermined time has passed, which is a time from the start of feeding of the sheet S to arrival of the sheet S to the registration sensor 101. When the control unit 50 determines that the first predetermined time has not passed, the processing returns to S103, and when the control unit 50 determines that the first predetermined time has passed, the processing proceeds to S301.

In view of this, in S301, the control unit 50 carries out the third driving operation of rotating the stepping motor 21 for the predetermined time by a larger current value at higher output than those in the first and second embodiments. Further, the control unit 50 resets the timer so as to measure the third predetermined time, which is a predetermined time for carrying out the third driving operation, and then starts the timer. In this embodiment, the value of the drive current is temporarily increased, to thereby increase the output of the stepping motor as compared to the first and second embodiments. Thus, the stepping motor is restored from the step-out state. Note that, the speed of the stepping motor 21 may be increased up to the same accelerated state as the first driving operation. The reason why the current value is not constantly increased in the first driving operation in the above-mentioned first and second embodiments is because, through the increase of the current value of the stepping motor 21, the temperature of the stepping motor 21 may be increased, and noise may be generated. In view of this, in this embodiment, although this operation is inapplicable to the first driving operation that is the normal feeding operation, the current value of the stepping motor 21 is temporarily increased only when the third driving operation is performed. In this manner, the plate 16 is controlled to be moved at a position separated from the sheet feeding roller 6.

In S302, the control unit 50 reads the timer value from the timer, and determines whether or not a third predetermined time has passed. When the third predetermined time has passed, the processing proceeds to S303, and when the third predetermined time has not passed, the processing in S302 is repeated. Note that, the rotation number of the stepping motor 21 is higher than those in the first and second embodiments. Therefore, the third predetermined time is set based on the rotation number, and is set to be shorter than the second predetermined time described above. In S303, the control unit 50 stops the third driving operation carried out by the sheet feeding device 10, to thereby finish the processing. At this time, similarly to the first embodiment, the plate 16 enters a state of being stopped at a position most separated from the sheet feeding roller 6 (FIG. 2B). In this embodiment, the rotational speed for restoring the stepping motor 21 from the step-out state is set faster than those in the first and second embodiments, and thus the stepping motor 21 can be restored from the step-out state earlier than in the first and second embodiments. This is because, as the rotation number is higher, the time required for the plate 16 to return to the most-separated position (FIG. 2B) may be shorter. As described above, according to this embodiment, in the apparatus using the low-output stepping motor, the plate can be restored to the normal state from the state of being urged to the sheet feeding roller.

In the above-mentioned embodiments, the friction coefficient of the surface of the sheet feeding roller 6 may be reduced due to the influence of ambient humidity and the like, and thus the roller 6 may continuously rotate without causing step-out of the stepping motor 21. For example, in the first embodiment, when no sheet S is stacked on the cassette 9, the motor 21 essentially falls out of step due to the contact between the roller 6 and the separation-pad 20. However, the motor 21 may not fall out of step even if the roller 6 and the pad 20 are brought into contact with each other due to reduction in the friction coefficient of the surface of the roller 6. In this case, the roller 6 is continuously rotated, and the plate 16 is moved down. On the other hand, no sheet S is fed from the cassette 9, and hence, based on the flow chart of FIG. 3, the control unit 50 executes the second driving operation (S109). That is, even though the plate 16 has already been moved down, the control unit 50 executes the second driving operation.

At this time, the following problems occur. That is, when the second driving operation is further executed under a state in which the plate 16 has already been moved down, the plate 16 is moved up reversely. As a countermeasure, in the above-mentioned embodiments, the meshing between the partially toothed gear 24 and the second drive gear 23 is controlled by the solenoid (not shown). When the solenoid is turned on, the rotation of the partially toothed gear 24 is started. Then, when the partially toothed gear 24 rotates one revolution, meshing with the second drive gear 23 is cancelled, to thereby stop the rotation. Then, the power of the motor 21 cannot be transmitted unless the solenoid is turned on again. Therefore, when the second driving operation is executed, the motor 21 is rotated without turning on the solenoid. In this manner, when the plate 16 has already been moved down, the partially toothed gear 24 does not rotate even if the motor 21 rotates, and hence the plate 16 does not rise. On the other hand, the plate 16 can be restored from the state in which the roller 6 and the plate 16 are brought into contact with each other.

Further, in the above-mentioned embodiments, the configuration in which the sheet S is fed from the cassette 9 has been described. However, the present invention is not limited thereto. For example, the present invention is also applicable to a configuration in which the sheet S is fed from a manual feed tray or a multi-tray. That is, any unit may be employed as long as the unit has a configuration in which the plate is moved up so as to feed the sheet S placed on the plate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-039124, filed Feb. 28, 2014 and Japanese Patent Application No. 2015-024266, filed Feb. 10, 2015, which are hereby incorporated by reference wherein in their entireties.

What is claimed is:

1. An image forming apparatus comprising:

a plate on which a sheet is placed, the plate being movable up and down;

a lift unit configured to move the plate up and down;

a feeding unit configured to come into contact with the sheet placed on the plate which is moved up by the lift unit, wherein the feeding unit rotates to feed the sheet with which the feeding unit contacts;

a driving unit configured to rotate to drive the lift unit and the feeding unit; and a control unit configured to control the driving unit so that the driving unit rotates; and a separating portion arranged on the plate for separating a plurality of sheets, wherein a friction coefficient of the separating portion is higher than a friction coefficient of the plate, wherein in a case where the feeding unit contacts with the separating portion arranged on the plate in a state where no sheet is placed on the plate and the feeding unit cannot rotate while the control unit controls the driving unit so that the driving unit rotates at a first rotation speed, the control unit controls the driving unit so that the driving unit rotates at a second rotation speed slower than the first rotation speed and faster than zero.

2. The image forming apparatus according to claim 1, wherein the control unit starts to control the driving unit so that the driving unit rotates at the first rotation speed in a first state where the feeding unit does not contact with the separating portion arranged on the plate, and then the lift unit starts to move the plate up and the feeding unit starts to rotate, wherein the feeding unit changes from the first state to a second state where the feeding unit contacts with the separating portion arranged on the plate while the control unit controls the driving unit so that the driving unit rotates at the first rotation speed.

3. The image forming apparatus according to claim 1, further comprising:

a detection unit configured to detect the sheet fed by the feeding unit, wherein in a case where the detection unit does not detect the sheet until a first predetermined time has passed from when the control unit starts to control the driving unit so that the driving unit rotates at the first rotation speed, the control unit determines that the feeding unit cannot rotate.

4. The image forming apparatus according to claim 3, wherein in a case where a second predetermined time has passed from when the control unit starts to control the driving unit so that the driving unit rotates at the second rotation speed, the control unit controls the driving unit so that the driving unit stops.

5. The image forming apparatus according to claim 4, wherein the second predetermined time includes a time required for the lift unit to move the plate to the farthest position from the feeding unit while the control unit controls the driving unit so that the driving unit rotates at the second rotation speed.

6. The image forming apparatus according to claim 4, wherein in a case where the detection unit detects the sheet until the second predetermined time has passed from when the control unit starts to control the driving unit so that the driving unit rotates at the second rotation speed, the control unit controls the driving unit so that the driving unit stops.

7. The image forming apparatus according to claim 4, wherein the lift unit comprises a cam configured to rotate in response to driving force from the driving unit, wherein the plate is moved up and down by a single rotation of the cam, and wherein the second predetermined time includes a time required for the single rotation of the cam while the control unit controls the driving unit so that the driving unit rotates at the second rotation speed.

8. The image forming apparatus according to claim 3, wherein the first predetermined time includes a time from when the feeding unit starts to feed the sheet placed on the plate to when a leading edge of the sheet fed by the feeding unit reaches the detection unit while the control units controls the driving unit so that the driving unit rotates at the first rotation speed.

9. The image forming apparatus according to claim 3, wherein the lift unit comprises a cam configured to rotate in response to drive from the driving unit, and wherein the plate is moved up and down by a single rotation of the cam.

10. The image forming apparatus according to claim 9, wherein the lift unit further comprises:

a first gear configured to rotate in response to the driving force from the driving unit;

a second gear configured to rotate by engagement with the first gear, wherein the engagement with the first gear is released by one rotation of the second gear;

a rotation shaft on which the cam and the second shaft are fixed; and a transmission unit configured to engage the first gear with the second gear and transmit the driving force from the driving unit to the cam.

11. The image forming apparatus according to claim 10, wherein in a case where the detection unit does not detect the sheet until the first predetermined time has passed from when the control unit starts to control the driving unit so that the driving unit rotates at the first rotation speed and to control the transmission unit so that the transmission unit engages the first gear with the second gear, the control unit controls the driving unit so that the driving unit rotates at the second rotation speed and does not control the transmission unit so that the transmission unit engages the first gear with the second gear.

12. The image forming apparatus according to claim 3, wherein the lift unit moves the plate up so as to bring the sheet placed on the plate into contact with the feeding unit, and moves the plate down so as to separate the sheet placed on the plate from the feeding unit.

13. The image forming apparatus according to claim 3, wherein the control unit changes the first rotation speed depending on a type of the sheet placed on the plate.

14. The image forming apparatus according to claim 3, wherein the lift unit moves the plate up and down for each feeding the sheet by the feeding unit.

15. The image forming apparatus according to claim 1, wherein the driving unit comprises a stepping motor, and wherein the second rotation speed is the slowest speed in a speed range in which of the stepping motor can rotate.

16. An image forming apparatus comprising:

a plate on which a sheet is placed, the plate being movable up and down;

a lift unit configured to move the plate up and down;

a feeding unit configured to come into contact with the sheet placed on the plate which is moved up by the lift unit, wherein the feeding unit rotates to feed the sheet with which the feeding unit contacts;

a driving unit configured to rotate to drive the lift unit and the feeding unit;

a control unit configured to control the driving unit so that the driving unit rotates; and a setting unit configured to set a type of the sheet, wherein in a case where the feeding unit contacts with the sheet placed on the plate in a state where a first type of the sheet placed on the plate is different from a second type of the sheet set by the setting unit and the feeding unit cannot rotate while the control unit controls the driving unit so that the driving unit rotates at a first rotation speed corresponding to the second type of the sheet, the control unit controls the driving unit so that the driving unit rotates at a second rotation speed slower than the first rotation speed and faster than zero.

17. The image forming apparatus according to claim 16, wherein the control unit starts to control the driving unit so that the driving unit rotates at the first rotation speed in a first state where the feeding unit does not contact with the sheet placed on the plate, and then the lift unit starts to move the plate up and the feeding unit starts to rotate, wherein the feeding unit changes from the first state to a second state where the feeding unit contacts with the sheet placed on the plate while the control unit controls the driving unit so that the driving unit rotates at the first rotation speed.

18. The image forming apparatus according to claim 16, wherein the type of the sheet is a thickness of the sheet.

19. The image forming apparatus according to claim 18, wherein the lift unit comprises a cam configured to rotate in response to drive from the driving unit, and wherein the plate is moved up and down by a single rotation of the cam.

20. The image forming apparatus according to claim 19, wherein the lift unit further comprises:

a first gear configured to rotate in response to the driving force from the driving unit;

a second gear configured to rotate by engagement with the first gear, wherein the engagement with the first gear is released by one rotation of the second gear;

a rotation shaft on which the cam and the second shaft are fixed; and a transmission unit configured to engage the first gear with the second gear and transmit the driving force from the driving unit to the cam.

21. The image forming apparatus according to claim 20, wherein in a case where the detection unit does not detect the sheet until the first predetermined time has passed from when the control unit starts to control the driving unit so that the driving unit rotates at the first rotation speed and to control the transmission unit so that the transmission unit engages the first gear with the second gear, the control unit controls the driving unit so that the driving unit rotates at the second rotation speed and does not control the transmission unit so that the transmission unit engages the first gear with the second gear.

22. The image forming apparatus according to claim 16, further comprising:

a detection unit configured to detect the sheet fed by the feeding unit, and wherein in a case where the detection unit does not detect the sheet until a first predetermined time has passed from when the control unit starts to control the driving unit so that the driving unit rotates at the first rotation speed, the control unit determines that the feeding unit cannot rotate.

23. The image forming apparatus according to claim 22, wherein in a case where a second predetermined time has passed from when the control unit starts to control the driving unit so that the driving unit rotates at the second rotation speed, the control unit controls the driving unit so that the driving unit stops.

24. The image forming apparatus according to claim 23, wherein the second predetermined time includes a time required for the lift unit to move the plate to the farthest position from the feeding unit while the control unit controls the driving unit so that the driving unit rotates at the second rotation speed.

25. The image forming apparatus according to claim 23, wherein in a case where the detection unit detects the sheet before the second predetermined time has passed from when the control unit starts to control the driving unit so that the driving unit rotates at the second rotation speed, the control unit controls the driving unit so that the driving unit stops.

26. The image forming apparatus according to claim 22, wherein the first predetermined time includes a time from when the feeding unit starts to feed the sheet placed on the plate to when a leading edge of the sheet fed by the feeding unit reaches the detection unit while the control units controls the driving unit so that the driving unit rotates at the first rotation speed.

27. The image forming apparatus according to claim 22, wherein the lift unit moves the plate up so as to bring the sheet placed on the plate into contact with the feeding unit, and moves the plate down so as to separate the sheet placed on the plate from the feeding unit.

28. The image forming apparatus according to claim 22, wherein the control unit changes the first rotation speed depending on a type of the sheet placed on the plate.

29. The image forming apparatus according to claim 22, wherein the lift unit moves the plate up and down for each feeding the sheet by the feeding unit.

30. The image forming apparatus according to claim 22, wherein the lift unit comprises a cam configured to rotate in response to driving force from the driving unit, wherein the plate is moved up and down by a single rotation of the cam, and wherein the second predetermined time includes a time required for the single rotation of the cam while the control unit controls the driving unit so that the driving unit rotates at the second rotation speed.

31. The image forming apparatus according to claim 16, wherein the driving unit comprises a stepping motor, and wherein the second rotation speed is the slowest speed in a speed range in which of the stepping motor can rotate.

32. An image forming apparatus comprising:

a plate on which a sheet is placed, the plate being movable up and down;

a lift unit configured to move the plate up and down;

a feeding unit configured to come into contact with the sheet placed on the plate which is moved up by the lift unit, wherein the feeding unit rotates to feed the sheet with which the feeding unit contacts;

a detection unit configured to detect the sheet fed by the feeding unit;

a driving unit configured to rotate to drive the lift unit and the feeding unit; and a control unit configured to control the driving unit so that the driving unit rotates, wherein in a case where the feeding unit contacts with the plate or the sheet placed on the plate and the feeding unit cannot rotate while the control unit controls the driving unit so that the driving unit rotates at a first rotation speed and the detection unit does not detect the sheet until a first predetermined time has passed from when the control unit starts to control the driving unit so that the driving unit rotates at the first rotation speed, the control unit controls the driving unit so that the driving unit rotates at a second rotation speed slower than the first rotation speed and faster than zero.

33. The image forming apparatus according to claim 32, wherein the first predetermined time includes a time from when the feeding unit starts to feed the sheet placed on the plate to when a leading edge of the sheet fed by the feeding unit reaches the detection unit while the control units controls the driving unit so that the driving unit rotates at the first rotation speed.

34. The image forming apparatus according to claim 32, wherein in a case where a second predetermined time has passed from when the control unit starts to control the driving unit so that the driving unit rotates at the second rotation speed, the control unit controls the driving unit so that the driving unit stops.

35. The image forming apparatus according to claim 34, wherein the second predetermined time includes a time required for the lift unit to move the plate to the farthest position from the feeding unit while the control unit controls the driving unit so that the driving unit rotates at the second rotation speed.

* * * * *